US011077331B2

(12) United States Patent
Ellis

(10) Patent No.: US 11,077,331 B2
(45) Date of Patent: Aug. 3, 2021

(54) DIRECT DRIVE RESISTANCE SYSTEM FOR EXERCISE MACHINES

(71) Applicant: Product Design Innovations, LLC, Ocala, FL (US)

(72) Inventor: Joseph K. Ellis, Ocala, FL (US)

(73) Assignee: Product Design Innovations, LLC, Ocala, FL (US)

( * ) Notice: Subject to any disclaimer, the term of this patent is extended or adjusted under 35 U.S.C. 154(b) by 21 days.

(21) Appl. No.: 16/259,179

(22) Filed: Jan. 28, 2019

(65) Prior Publication Data

US 2020/0238125 A1 Jul. 30, 2020

(51) Int. Cl.
*A63B 21/00* (2006.01)
*A63B 21/06* (2006.01)
*A63B 23/04* (2006.01)

(52) U.S. Cl.
CPC .... *A63B 21/0615* (2013.01); *A63B 21/00072* (2013.01); *A63B 21/159* (2013.01); *A63B 23/0405* (2013.01)

(58) Field of Classification Search
CPC ..... A63B 21/00072; A63B 21/159; A63B 23/0405; A63B 21/00058–00072; A63B 21/0615–0618; A63B 21/00185; A63B 21/002–0023; A63B 21/0085–0087; A63B 21/02–026; A63B 21/0407–0442; A63B 21/06–0607; A63B 21/072; A63B 21/0728–075; A63B 21/078; A63B 21/08; A63B 22/0007–001; A63B 2022/003–0043; A63B 22/0046; A63B 22/0048; A63B 22/20; A63B 23/035–0355; A63B 23/03575–0429
See application file for complete search history.

(56) References Cited

U.S. PATENT DOCUMENTS 5,352,171 A * 10/1994 Lin ..... A63B 21/00072 482/137
6,244,996 B1 * 6/2001 Sencil ..... A63B 21/0615 482/137
6,312,365 B1 * 11/2001 Koenig ..... A63B 21/0615 482/93
6,971,978 B2 * 12/2005 Hyder ..... A61H 1/0274 482/100
7,938,760 B1 * 5/2011 Webber ..... A63B 23/1263 482/97
2007/0232464 A1 * 10/2007 Chu ..... A63B 21/00181 482/96

* cited by examiner

*Primary Examiner* — Loan B Jimenez
*Assistant Examiner* — Catrina A Letterman
(74) *Attorney, Agent, or Firm* — Laurence P. Colton; Smith Tempel Blaha LLC

(57) ABSTRACT

A direct drive resistance system for exercise machines having a weighted moment arm that is lifted and lowered by a lifting moment arm and lifting component, which is moved by a force transfer assembly, which is operatively connected to a rotary component of an exercise machine, such that when the exercise machine is activated the force transfer assembly, the lifting moment arm, the lifting component and the weighted moment arm move concurrently to create a resistance force to the motion of the exercise machine.

6 Claims, 17 Drawing Sheets

DIRECT DRIVE RESISTANCE SYSTEM FOR EXERCISE MACHINES

BACKGROUND OF THE INVENTION

Technical Field

This invention relates to the general technical field of exercise, physical fitness, and physical therapy equipment and machines. This invention relates more specifically to the field of resistance systems for exercise machines.

Prior Art

Exercise, physical fitness, and physical therapy equipment and machines are available in various configurations and for various purposes, and are available for all of the major muscle groups. The majority of such equipment and machines, especially in the exercise field, generally concentrate either on an aerobic workout for cardiovascular conditioning or an anaerobic workout such as weight lifting to strengthen specific areas or muscle groups of the body such as the legs, the hips and lower torso, the chest and upper torso, the back, the shoulders, and the arms. The operations of these machines often concentrate on a single muscle group such as biceps, pectorals, quadriceps, and so forth. There are numerous examples each of these different types of exercise equipment and machines.

Generally, weight lifting equipment and machines can be categorized into three broad categories: free weights such benches and barbells, mechanically operated resistance machines that provide resistance with a stack of weight plates that are operatively connected to the user engagement, and mechanically operated resistance machines that provide the resistance through alternative means such as pneumatics, hydraulics, elastic bands, and other resistance mechanisms.

The most common resistance system for mechanically operated exercise machines for many decades has been a system comprised of a stack of individual weight plates that slide up and down a set of vertical guide rods and are raised and lowered by a flexible component such as a belt or cable which is guided by a series of pulleys such that the flexible component operatively connects the stack of weight plates to the user engagement means. However, there are many deficiencies with this system. First, there is a substantial amount of friction or drag created by the weight plates sliding up and down the guide rods. Second, there is a good bit of maintenance required to keep the guide rods lubricated to reduce drag as well as adjustment and tensioning of the flexible component. Third, the flexible components such as cables tend to wear with usage and require replacing. Fourth, if the machines are operated rapidly, the flexible components can lose tension causing slack and jerky movements that can damage the machine and possibly injure the user. Fifth, these multiple components also increase the cost of the machines. The present invention eliminates these deficiencies by eliminating many of the components, while maintaining the genuine feel of lifting gravity fed weights that exercise enthusiasts prefer.

BRIEF SUMMARY OF THE INVENTION

The present invention provides a direct drive resistance system comprised of two moment arms that are operatively connected to an exercise machine with rigid pivoting components. A first moment arm comprises a lifting component that in preferred embodiments is a wheel that acts upon a second moment arm when the system is activated. A second moment arm comprises a mass of weight that can be mounted anywhere on the second moment arm but in preferred embodiments is distal to the pivot axle of the second moment arm. A rotary component of the exercise machine is operatively connected to a force transfer assembly of the direct drive resistance system and in some embodiments the exercise machine and the force transfer assembly share a common axle.

During operation of the exercise machine, force is exerted by the user and transferred to the rotary component of the exercise machine and concurrently to a drive axle of the force transfer assembly, which concurrently transfers the force to at least one push rod, which concurrently transfers the force to a lifting moment arm, which concurrently transfers the force to a weighted moment arm such that the force generated by the user during operation of the exercise machine lifts the pivoting weighted moment arm wherein the weight provides a resistance to the exercise motion. The rotary component of the exercise machine, the drive axle of the force transfer assembly, and the pivoting axles of the first and second moment arms of the direct drive resistance system move only partial rotations of less than 180 degrees back and forth during operation of the system.

In certain embodiments, the lifting moment arm and the weighted moment arm pivot on separate axles that are in two separate locations wherein as the lifting moment arm acts upon the weighted moment arm, the lifting moment arm contact point to the weighted moment arm moves along the weighted moment arm as the lifting moment arm is lifting or lowering the weighted moment arm such that the resistance force that is transferred to the user is either increasing or decreasing during the operational movement of the exercise machine. This is a unique and beneficial feature in that it is optimal for certain exercises that the resistance to the motion of the exercise machine increases or decreases while the user is operating the exercise machine.

In other embodiments, the lifting moment arm and the weighted moment arm pivot on a common axle wherein as the lifting moment arm acts upon the weighted moment arm, the lifting moment arm contact point to the weighted moment arm remains virtually constant as the lifting moment arm is lifting or lowering the weighted moment arm such that the resistance force that is transferred to the user remains virtually constant during the operational movement of the exercise machine. This is a beneficial feature in that it is optimal for certain exercises that the resistance to the motion of the exercise machine remains constant while the user is operating the exercise machine.

In all preferred embodiments of the invention, the contact point of the lifting moment arm to the weighted moment arm can be adjusted prior to operating the machine so as to set the amount of starting resistance the direct drive resistance system generates.

DETAILED DESCRIPTION OF PREFERRED EMBODIMENTS

Exemplary preferred embodiments are disclosed below in connection with the attached drawings. Throughout this specification, various terms will be used to describe various components or features. For example, the term exercise machine will refer to any machine that can be operatively connected to the invention for physical fitness exercising such as a leg press, chest press, biceps curl, triceps extension, and other machines that exercise various muscle groups. The term pivot, rotary component, or axle will refer to the rotational point of a component or feature. The term weighted moment arm will refer to the total weight of the weighted moment arm; however, a substantial portion of the total weight will be comprised of a weight mass that in the preferred embodiments will be located at a distal end to the pivot point of the weighted moment arm. The term lifting point will refer to the contact point where the lifting moment arm and the weighted moment arm intersect and this point may be movable during operation of the machine.

Figure 1:
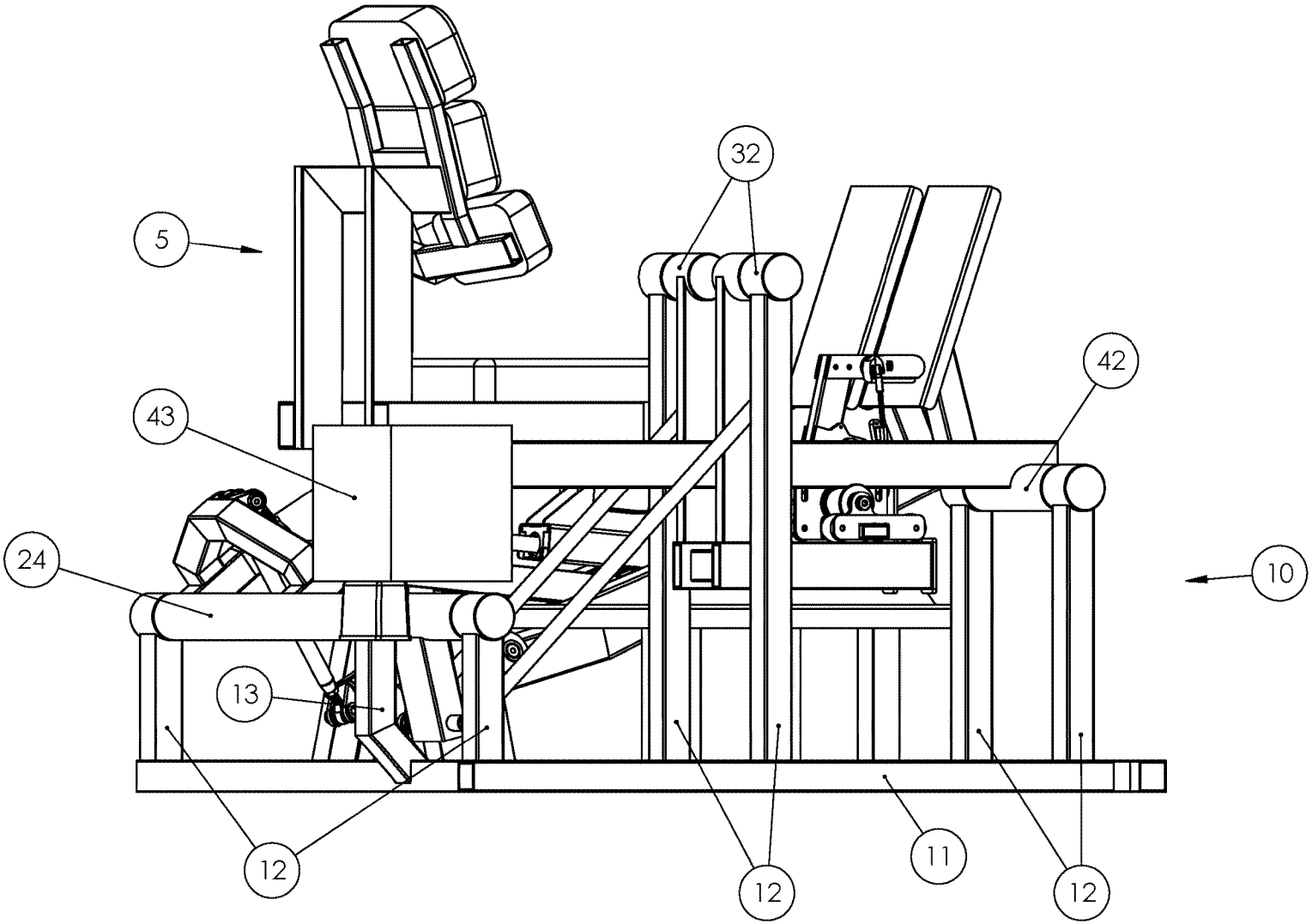
FIG. 1 is a perspective view of the invention in the at rest position and operatively connected to an exercise machine.
Figure 2:
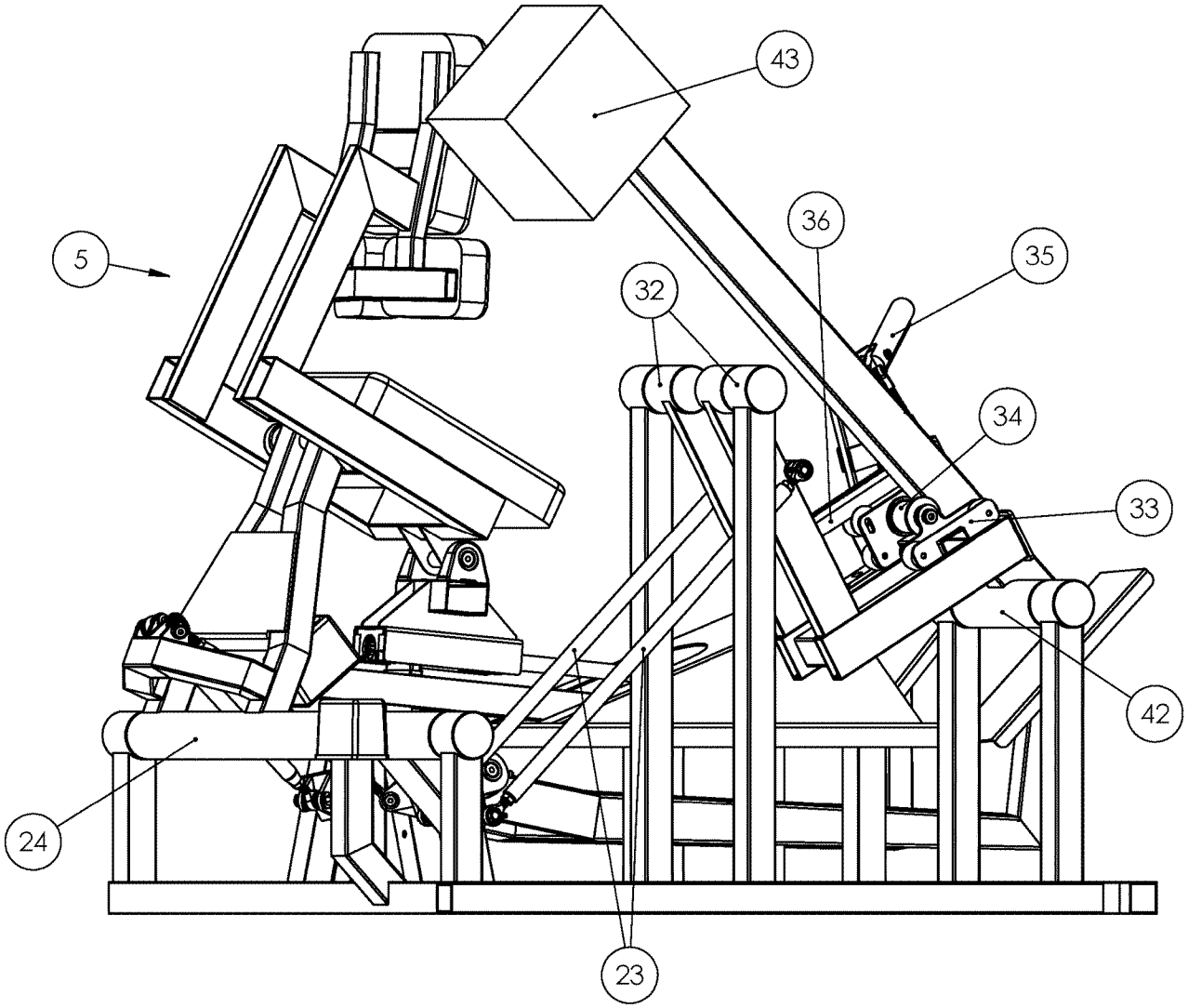
FIG. 2 is a perspective view of the invention in the activated position and operatively connected to an exercise machine.
Figure 3:
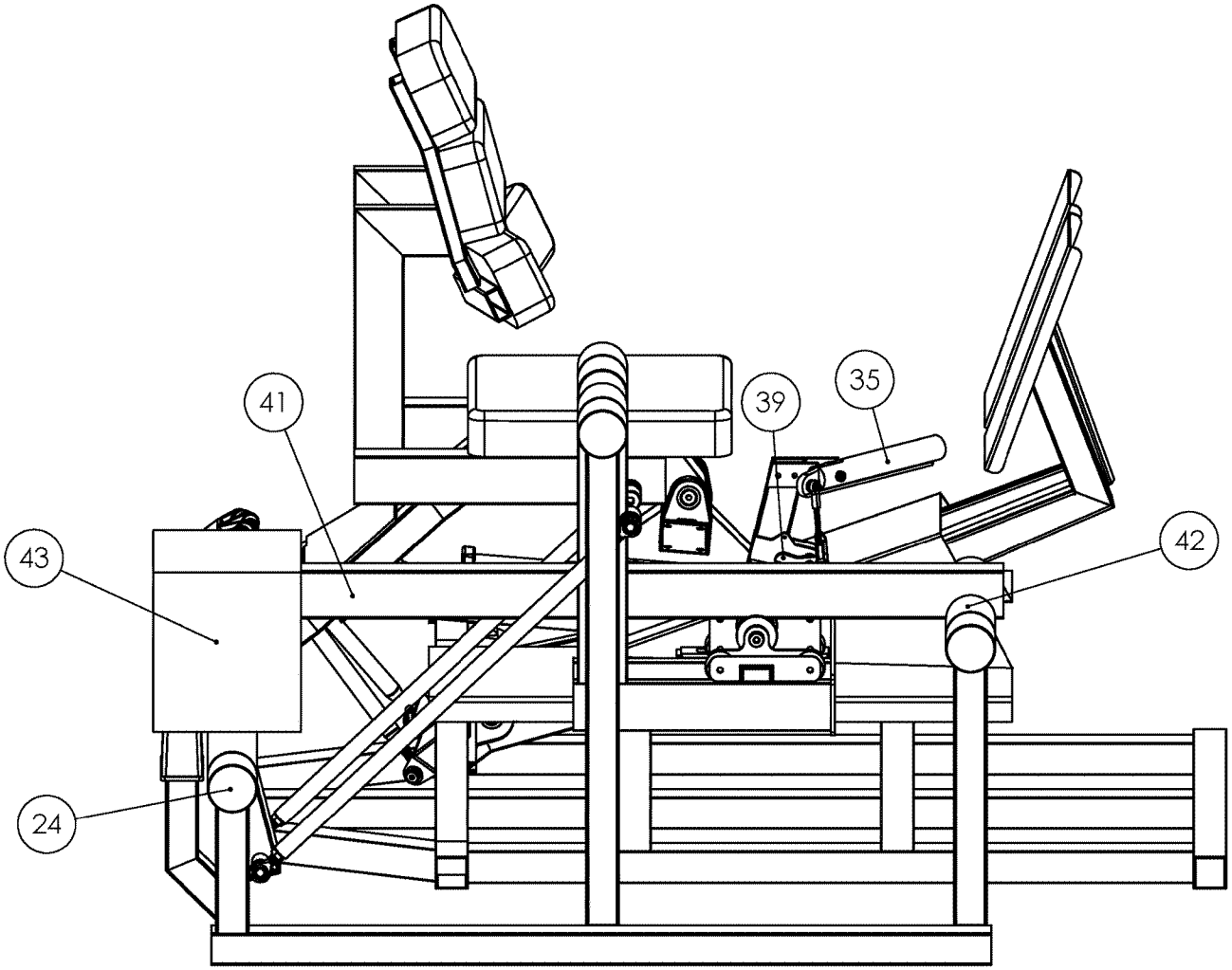
FIG. 3 is a perspective view of the invention in the at rest position and operatively connected to an exercise machine.
Figure 4:
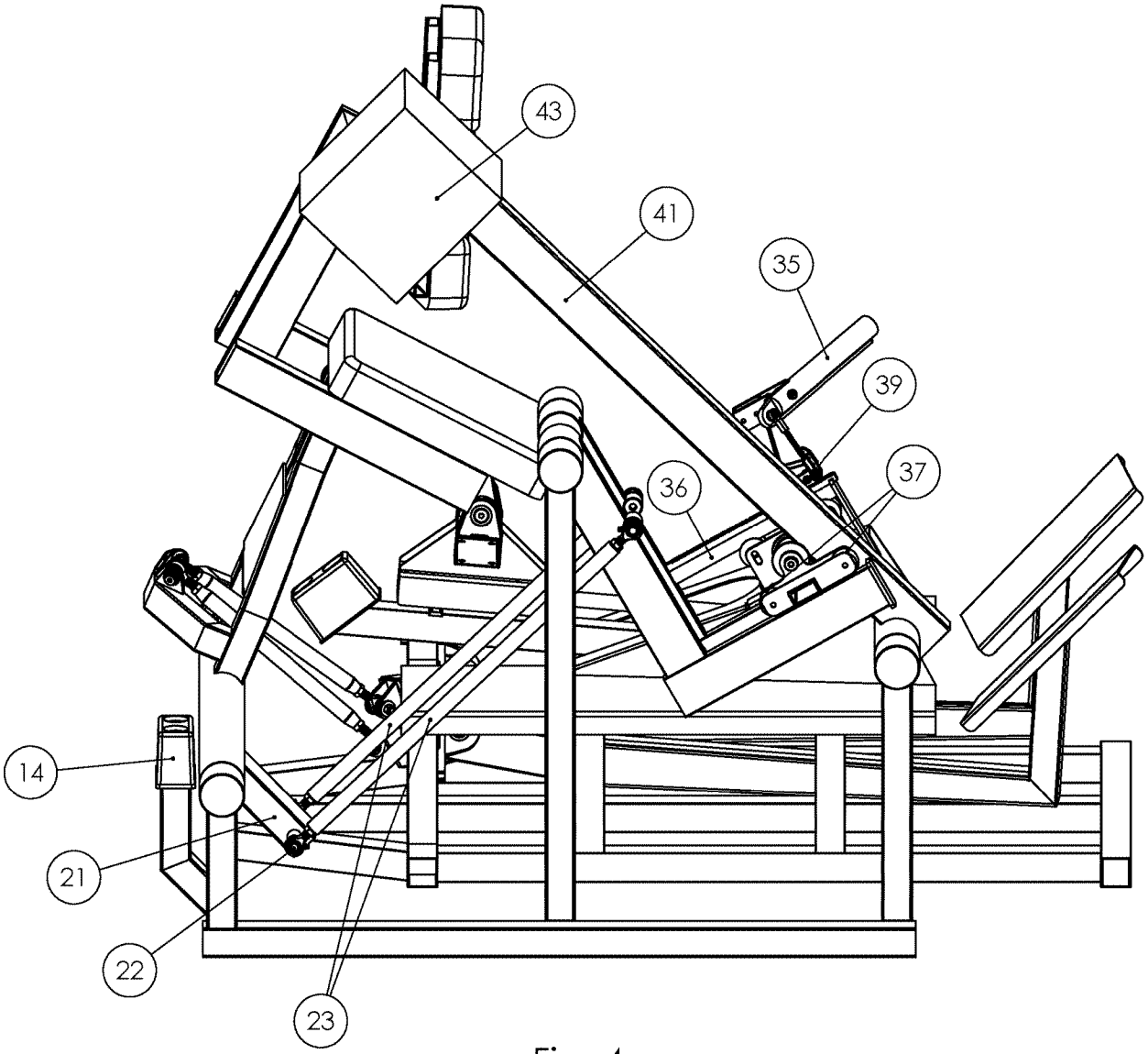
FIG. 4 is a perspective view of the invention in the activated position and operatively connected to an exercise machine.
Figure 5:
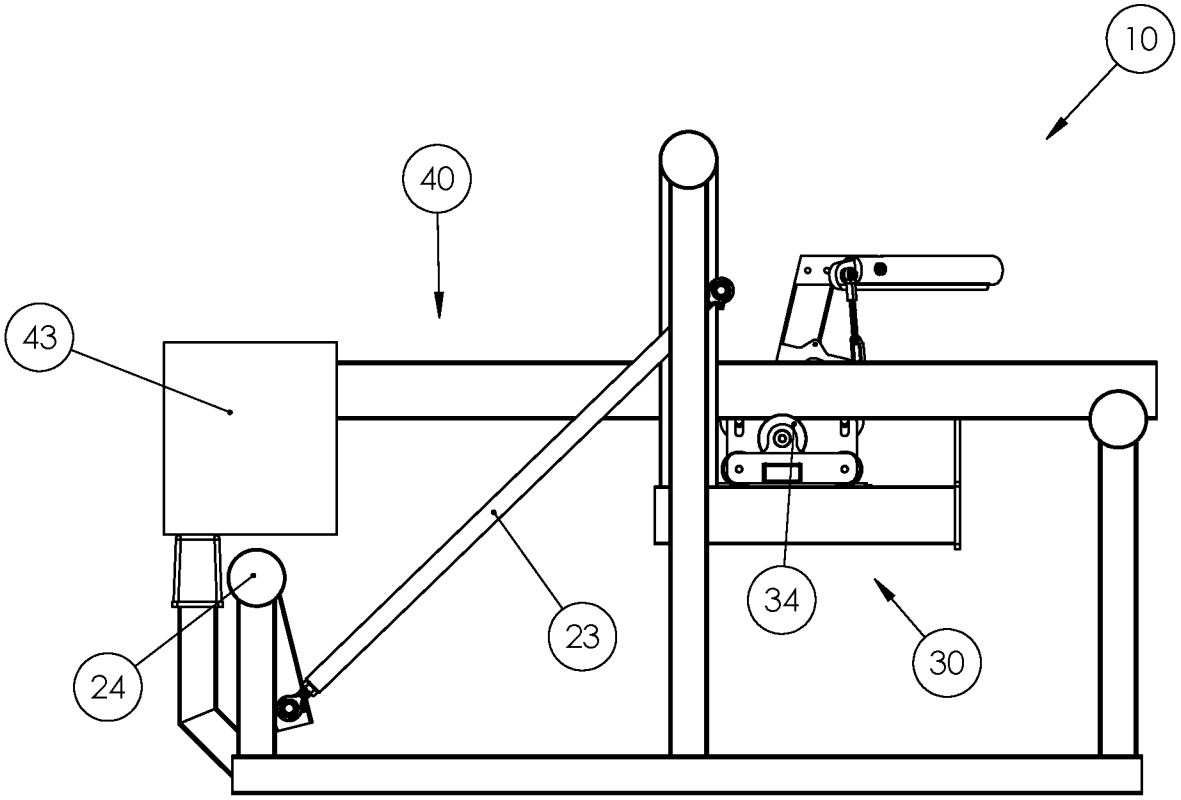
FIG. 5 is a side view of the invention in the at rest position wherein the two moment arms pivot in opposing directions and the resistance is at a lower setting.
Figure 6:
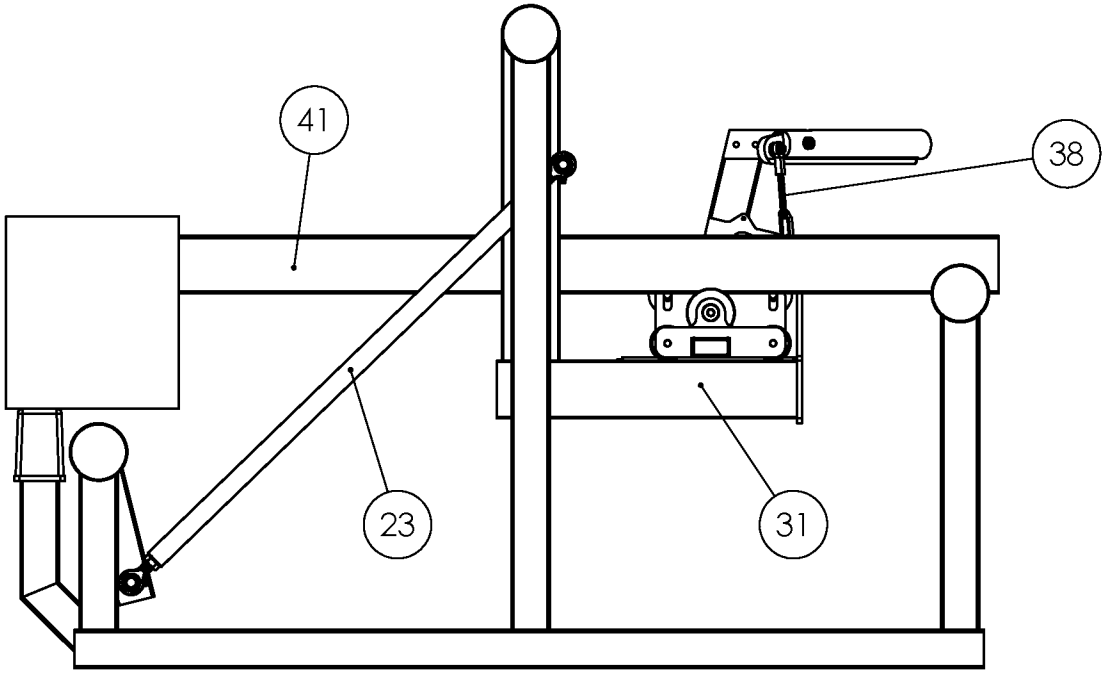
FIG. 6 is a side view of the invention in the at rest position wherein the two moment arms pivot in opposing directions and the resistance is at a higher setting.
Figure 7:
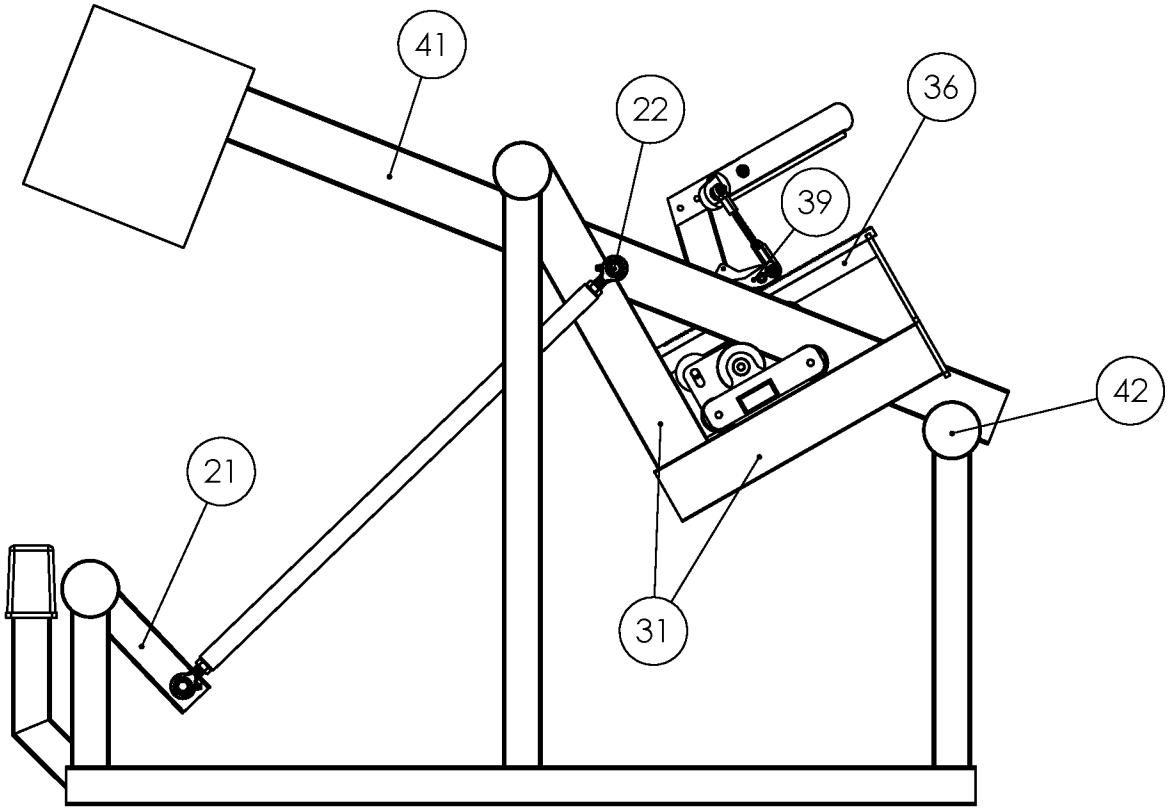
FIG. 7 is a side view of the invention in the activated position wherein the two moment arms pivot in opposing directions and the resistance is at a lower setting.
Figure 8:
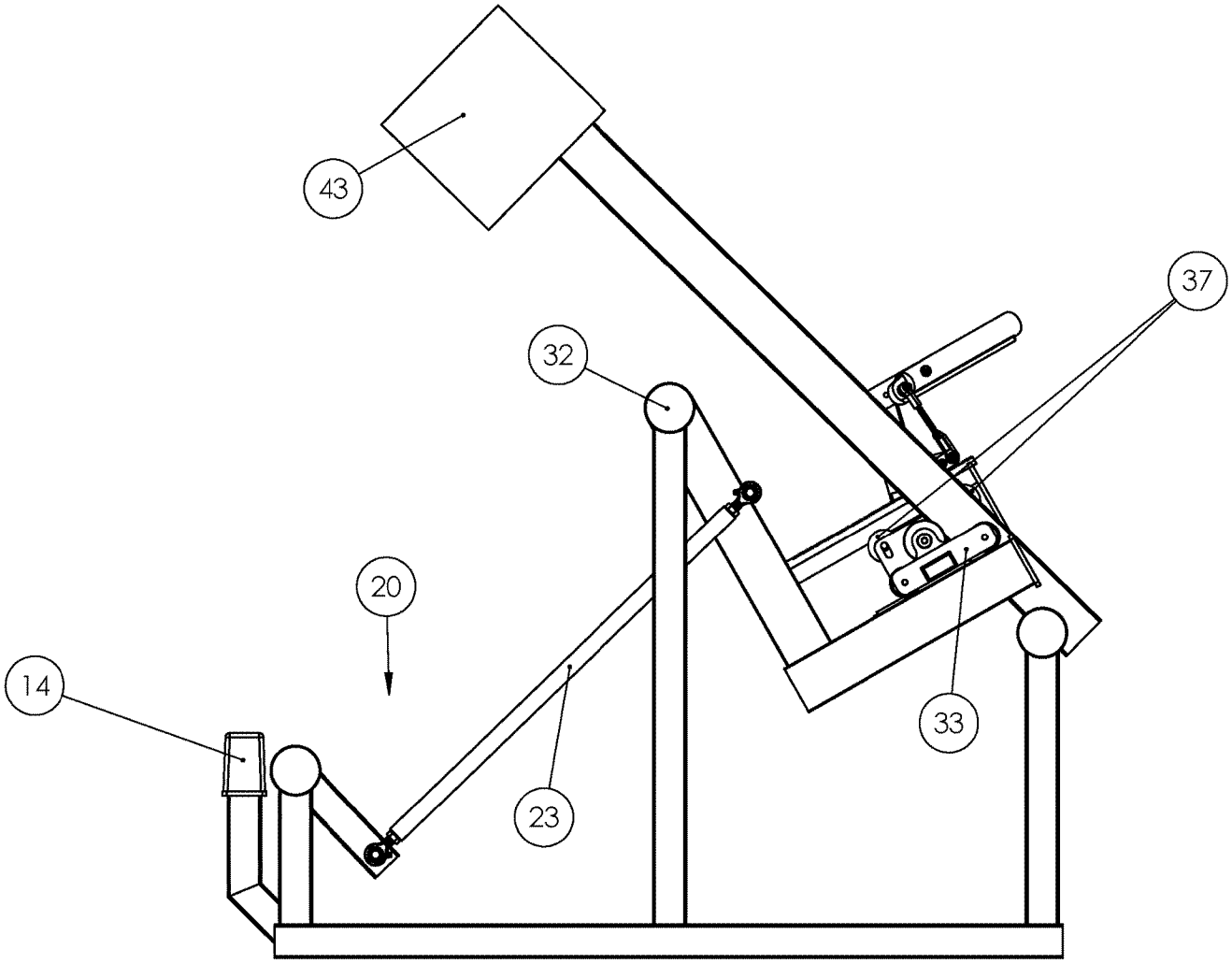
FIG. 8 is a side view of the invention in the activated position wherein the two moment arms pivot in opposing directions and the resistance is at a higher setting.
Figure 9:
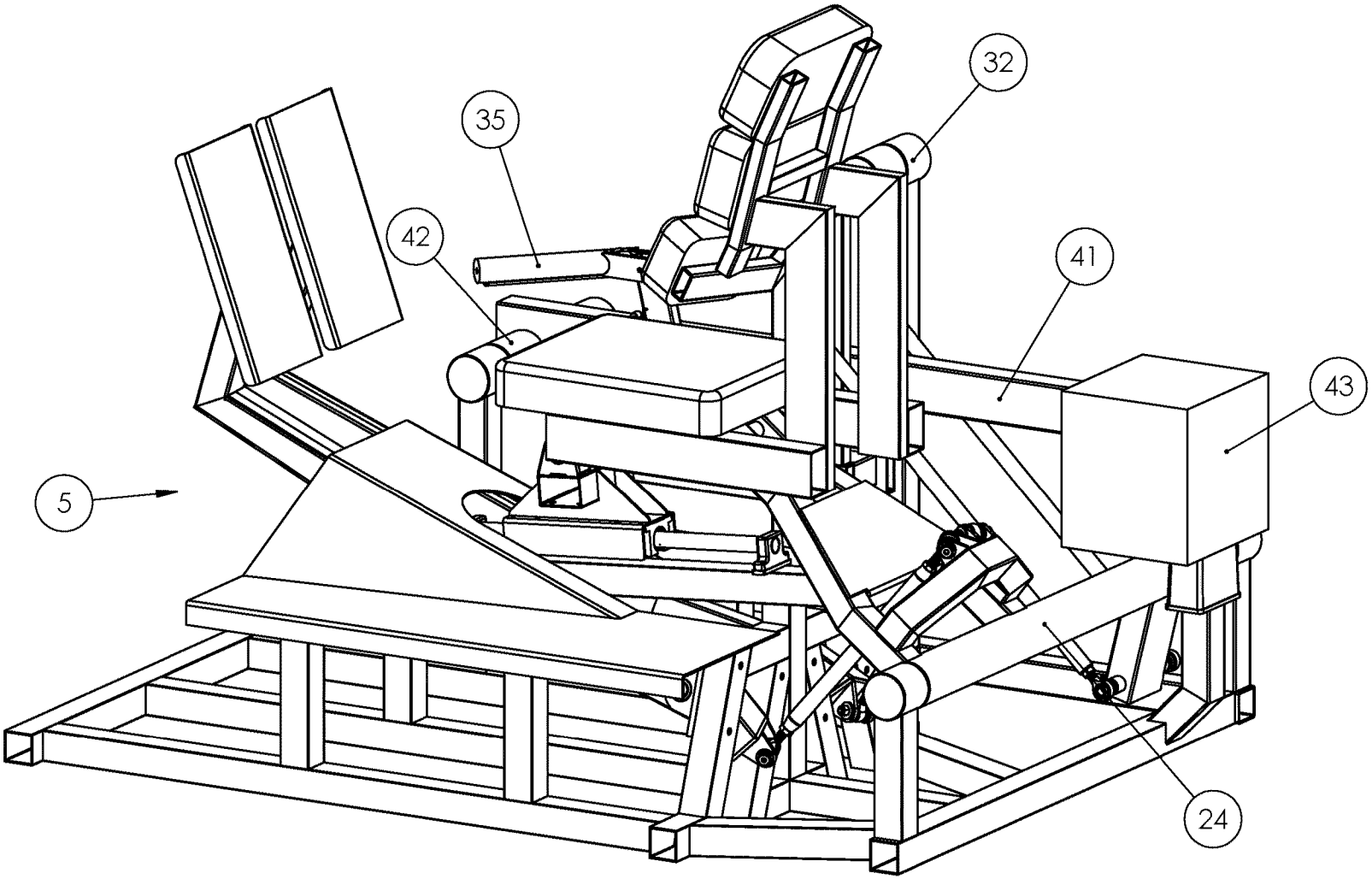
FIG. 9 is a perspective view of the invention in the at rest position and operatively connected to an exercise machine.
Figure 10:
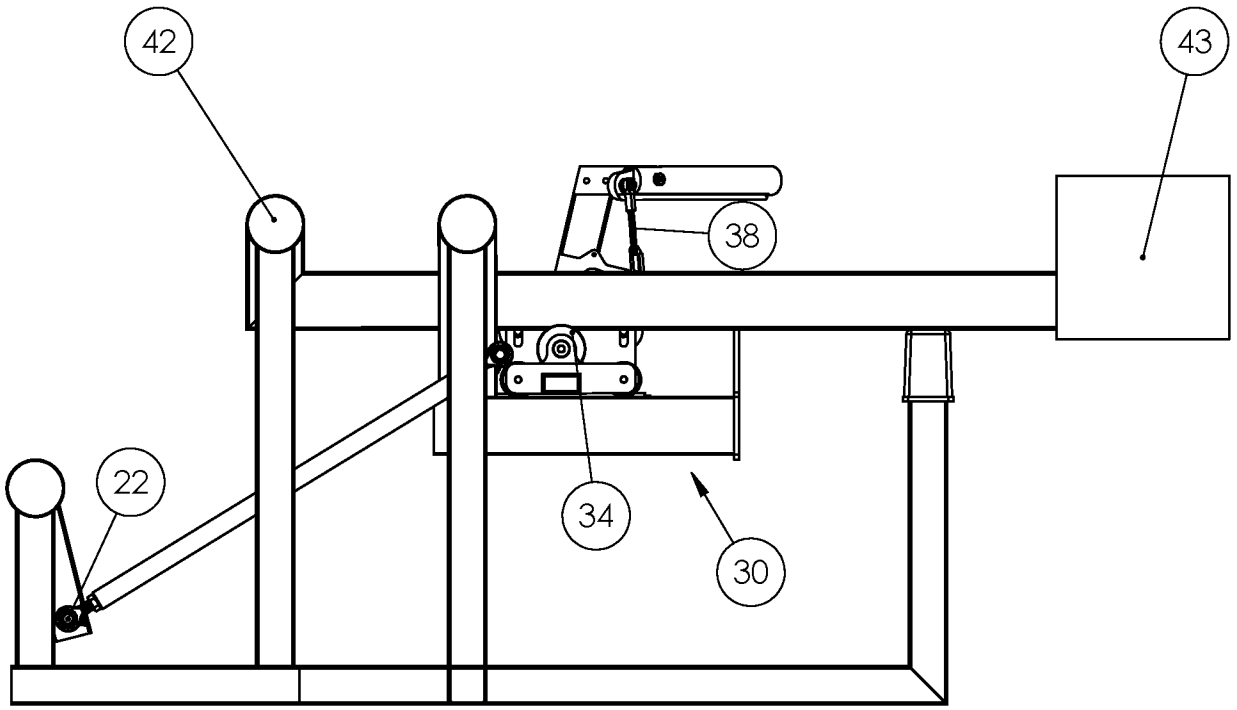
FIG. 10 is a side view of the invention in the at rest position wherein the two moment arms pivot in the same direction and the resistance is at a lower setting.
Figure 11:
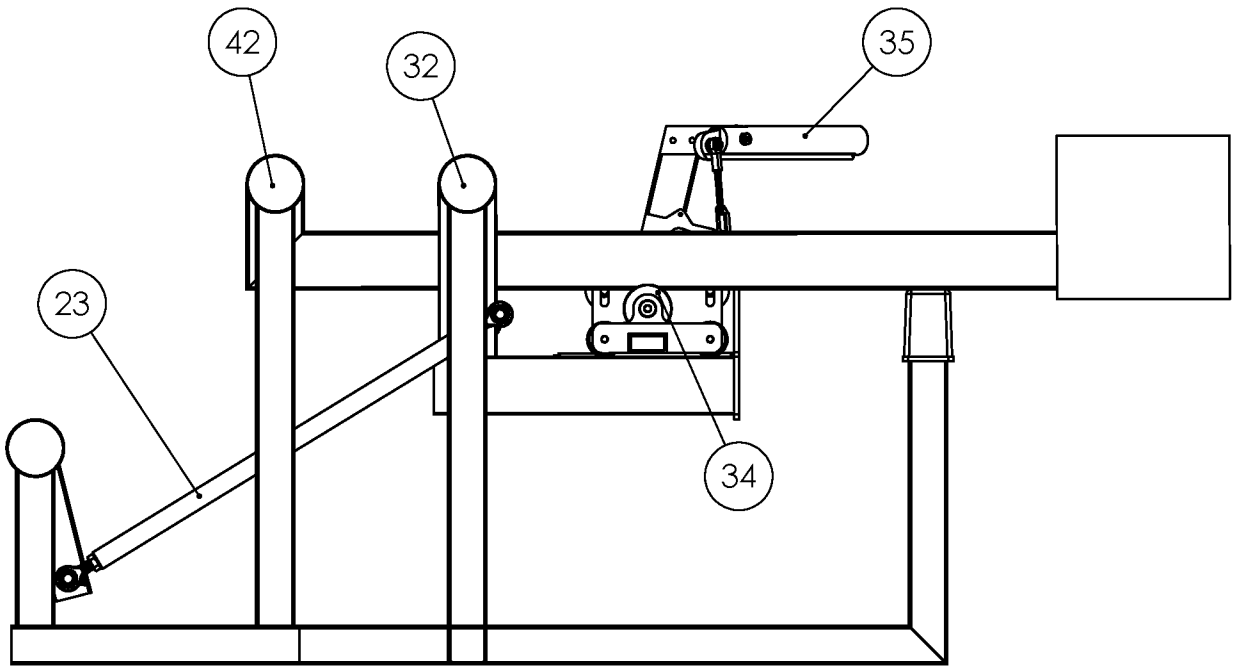
FIG. 11 is a side view of the invention in the at rest position wherein the two moment arms pivot in the same direction and the resistance is at a higher setting.
Figure 12:
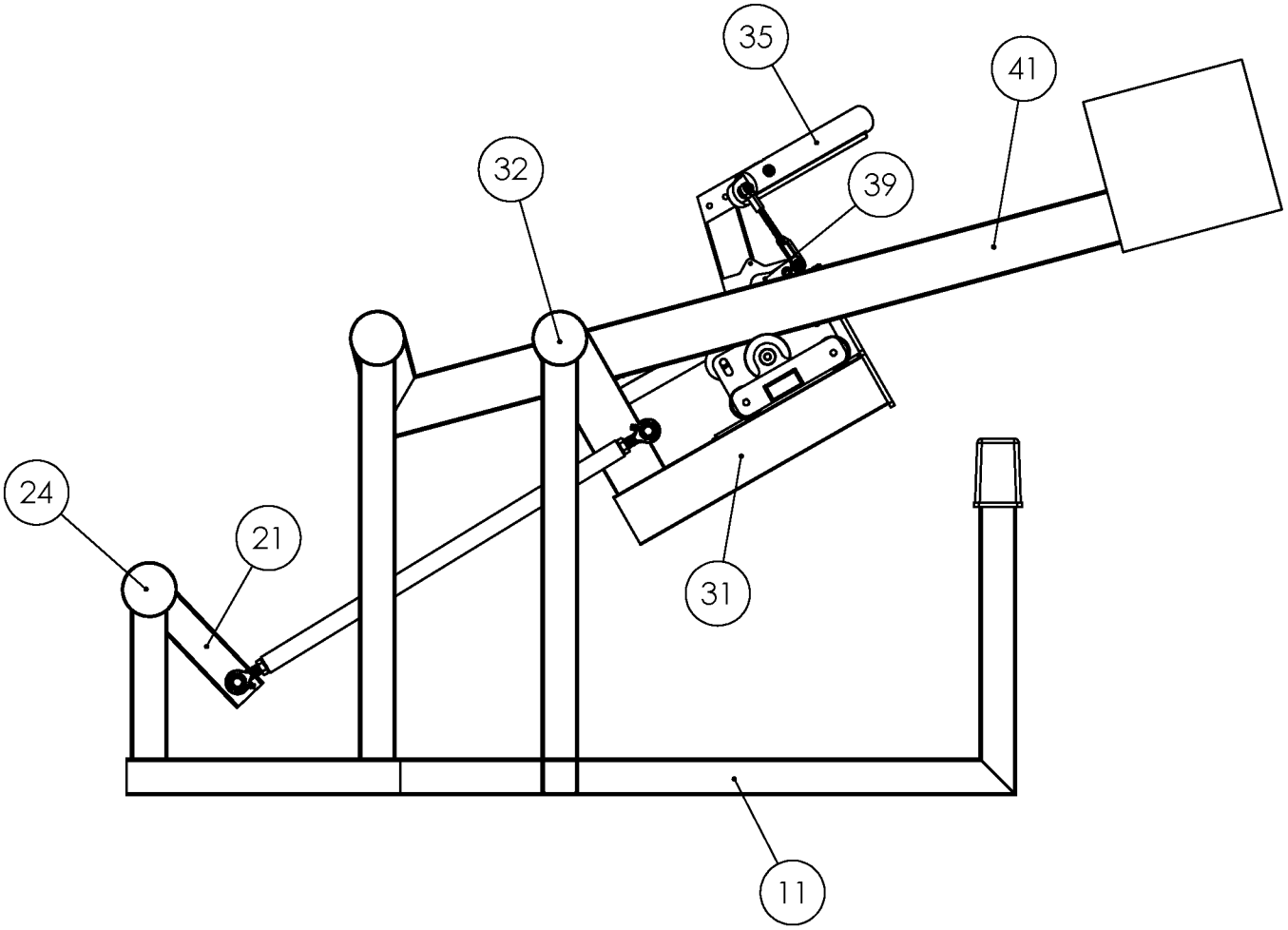
FIG. 12 is a side view of the invention in the activated position wherein the two moment arms pivot in the same direction and the resistance is at a higher setting.
Figure 13:
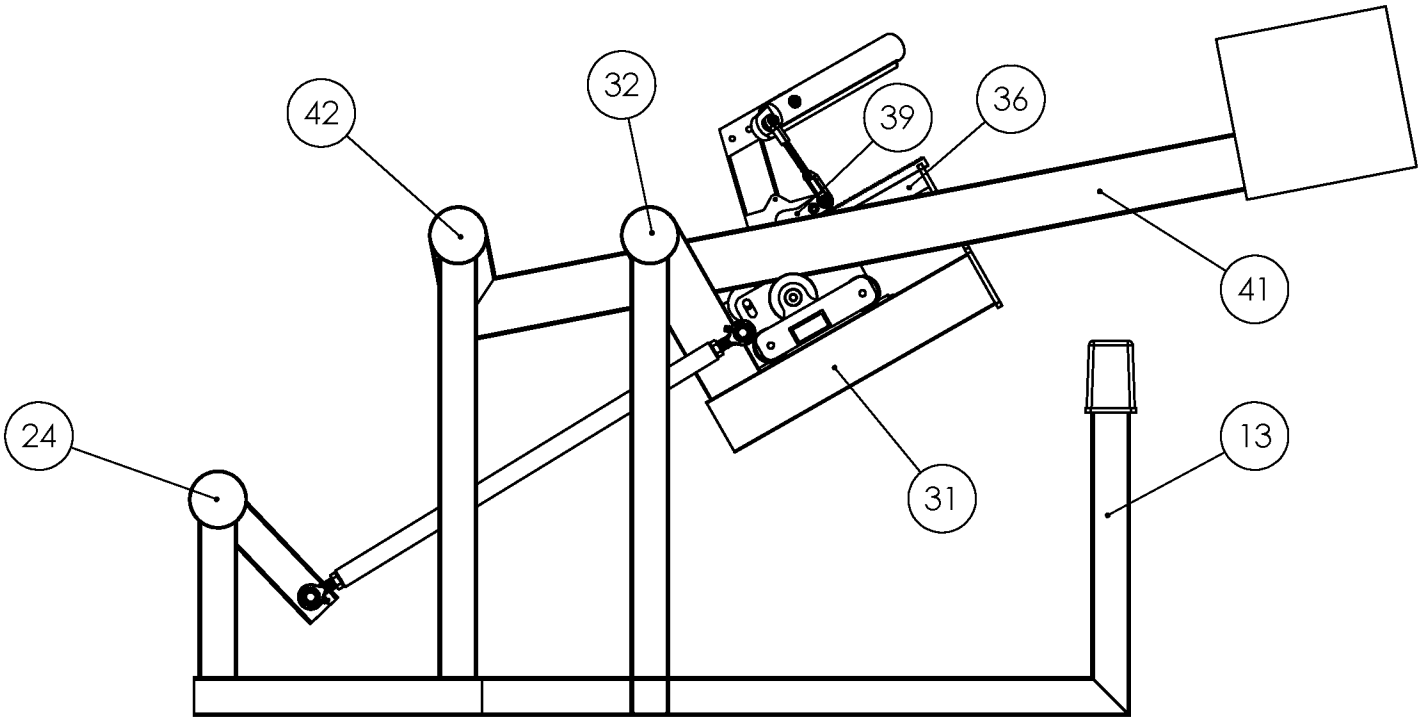
FIG. 13 is a side view of the invention in the activated position wherein the two moment arms pivot in the same direction and the resistance is at a lower setting.
Figure 14:
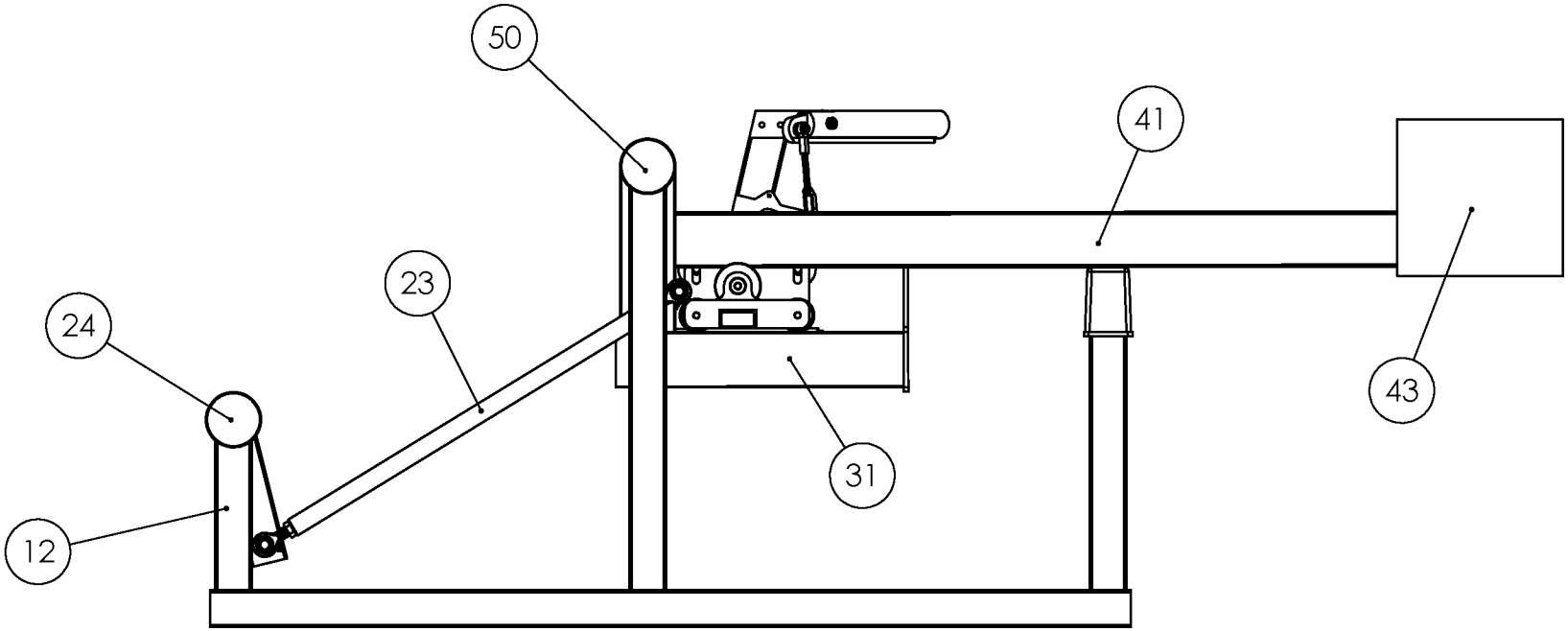
FIG. 14 is a side view of the invention in the at rest position wherein the two moment arms pivot on a common axle and the resistance is at a lower setting.
Figure 15:
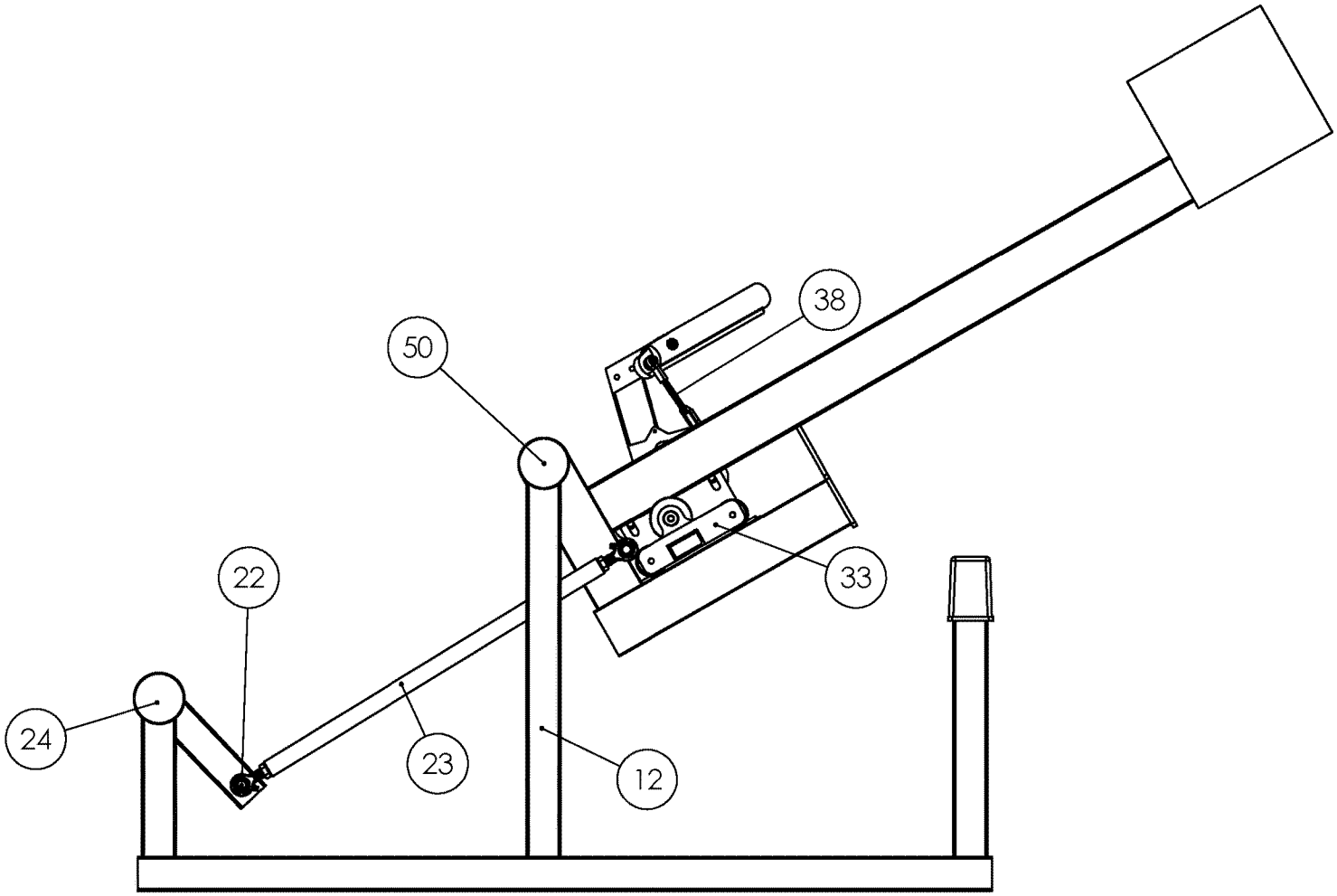
FIG. 15 is a side view of the invention in the activated position wherein the two moment arms pivot on a common axle and the resistance is at a lower setting.
Figure 16:
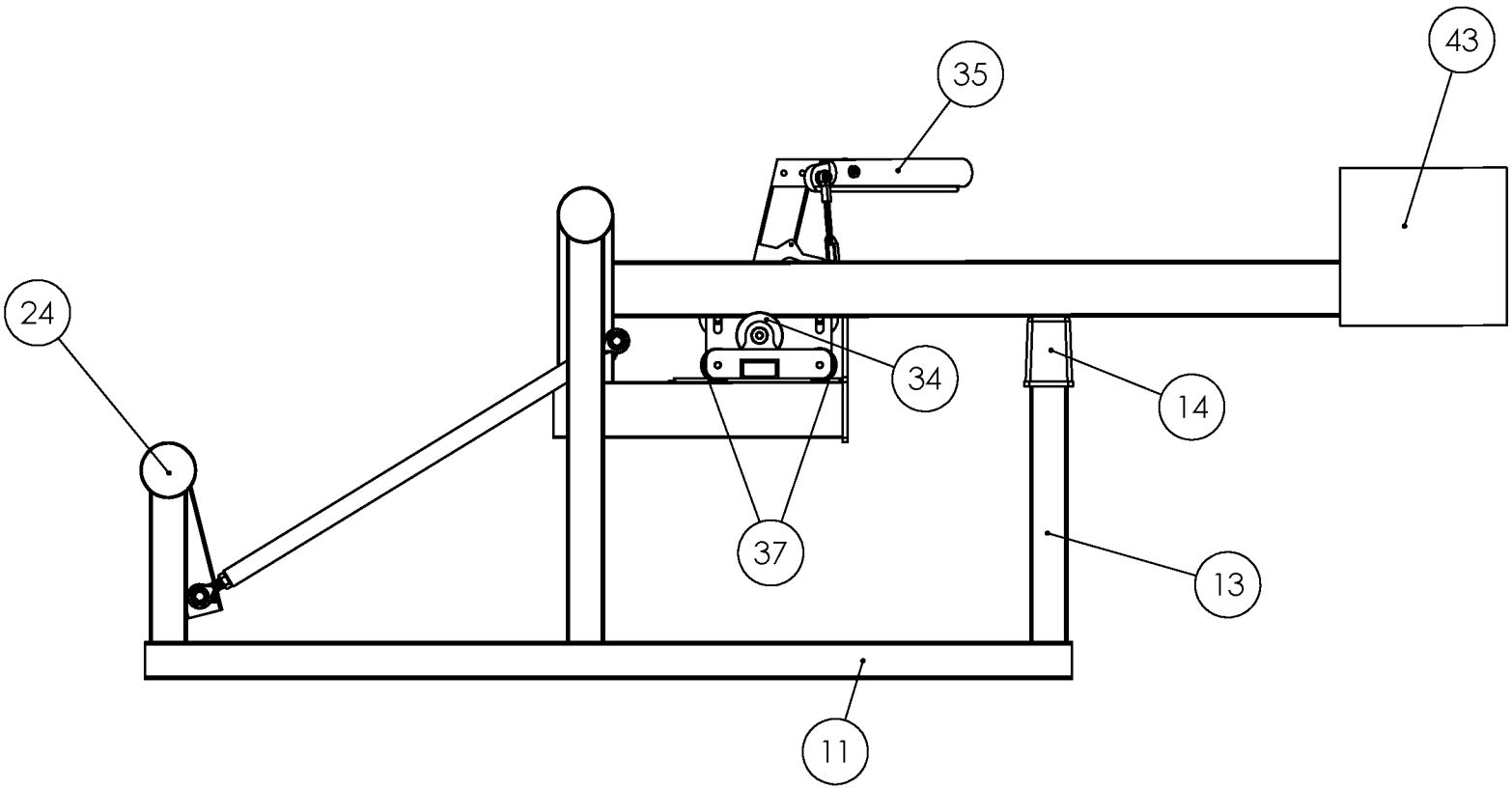
FIG. 16 is a side view of the invention in the at rest position wherein the two moment arms pivot on a common axle and the resistance is at a higher setting.
Figure 17:
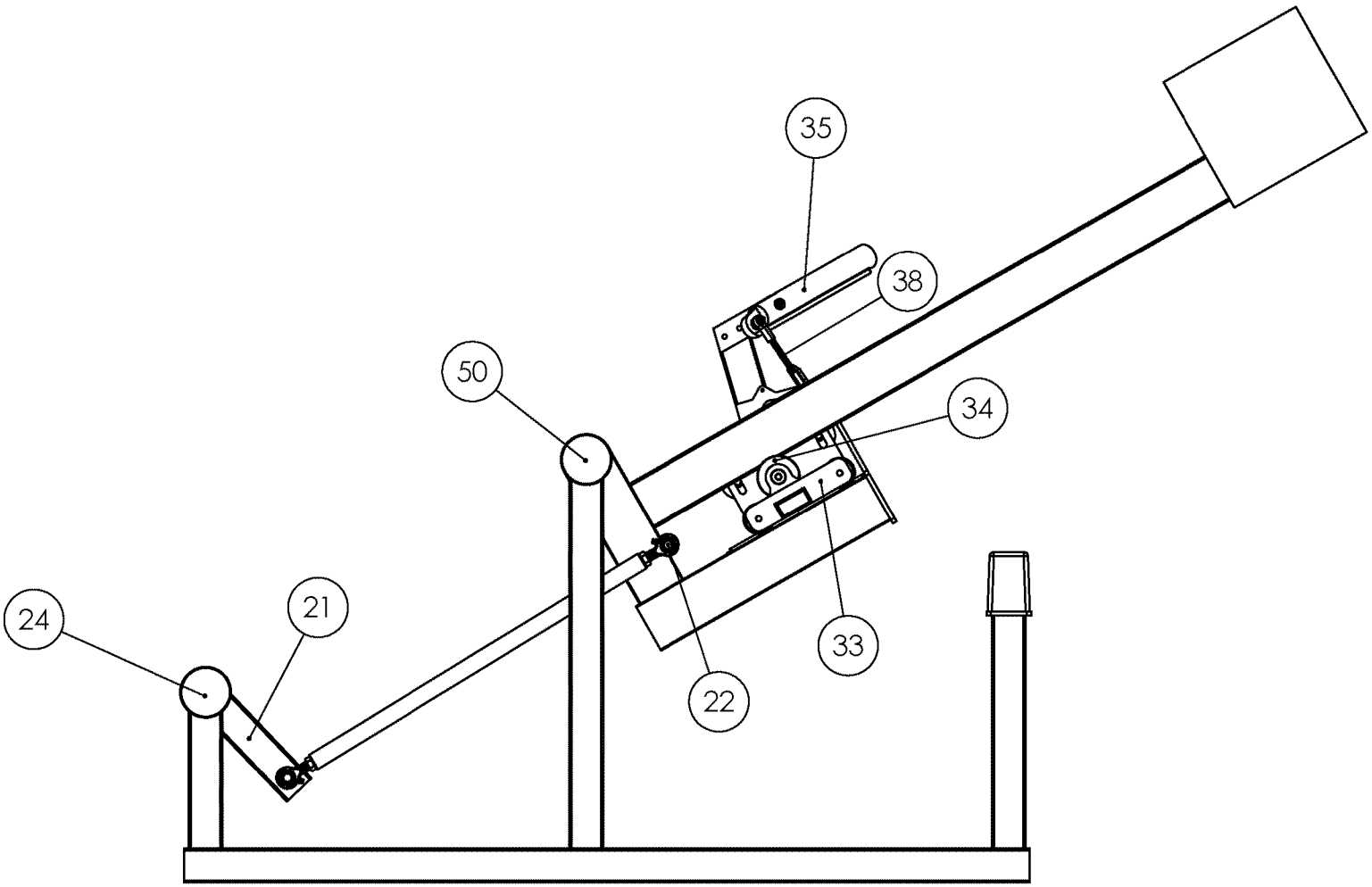
FIG. 17 is a side view of the invention in the activated position wherein the two moment arms pivot on a common axle and the resistance is at a higher setting.

FIGS. 1-17 are all views of preferred embodiments of the invention this inventor terms a Direct Drive Resistance System For Exercise Machines. Generally, the invention is a device that is operatively connected to an exercise machine for creating resistance to the motion of the exercise machine wherein a first moment arm lifts and lowers a second moment arm during operation of the exercise machine. The two moment arms can interact in various configurations to create the optimal resistance ratio for the motion of various exercise machines. The invention also can be configured to optimize space requirements when connected to the exercise machine and can be configured for convenient access to the resistance setting component of the invention by the user of the exercise machine. The components and supporting structure of the device can be constructed of any material capable of supporting and operating the device with metal components being the most common component material.

Referring now to FIGS. 1-17, various views of preferred embodiments of the device 10 are shown to provide a more complete understanding of the invention. In all preferred embodiments, the components of the device 10 are supported on a structural support frame such as base frame 11, and the moment arm axles 32 and 42 and the drive axle 24 are supported by axle support tubes 12. Bumper 14 is supported by bumper support tube 13.

In all preferred embodiments, weighted moment arm 40 is comprised of weight arm 41, weight mass 43, and weighted moment arm axle 42. Generally, a weight mass such as weight mass 43 being positioned distal to weighted moment arm axle 42 provides the most resistance with the least amount of total weight; however, the weight mass of weighted moment arm 40 can be distributed in various configurations suitable for the operation for device 10. The configuration of weight arm 41 can vary but is generally an elongated linear structure strong enough to support weight mass 43 with minimal deflection or deforming during operation of device 10.

In all preferred embodiments, lifting moment arm 30 is comprised of a lifting arm 31, a lifting component such as wheel 34, a lifting arm wheel carriage 33, lifting wheel carriage adjusting handle 35, a latching and unlatching mechanism such as lifting wheel carriage latch 39, and a lifting moment arm axle 32. Lifting wheel carriage 33 is movably supported by lifting wheel carriage wheels 37 and guided by lifted wheel carriage guide 36. Lifting wheel carriage 33 can be configured with various components suitable for supporting lifting wheel carriage 33 and slidably adjusting it to various positions along lifting arm 31. Lifting wheel carriage adjustment handle 35 is operatively connected to lifting wheel carriage latch 39 with lifting wheel carriage adjustment linkage 38. The configuration of lifting arm 31 can vary but is generally an "L" shaped structure strong enough to support lifting wheel carriage 33 and weighted moment arm 40 with minimal deflection or deforming during operation of device 10.

In all preferred embodiments, a force transfer assembly 20 is comprised of a drive axle 24, at least one push rod connection tube 21, at least one push component such as push rod 23, and push rod pivots 22. In certain embodiments, such as those illustrated in FIGS. 1-4 and 9, drive axle 24 may share a common axle with a rotary component of an exercise machine such as exercise machine 5.

FIGS. 1-13 illustrate embodiments of the invention in which lifting moment arm 30 and weighted moment arm 40 pivot on separate axles in separate locations. During operation of these embodiments, lifting wheel 34 will move along the lower central portion of weight arm 41 while it lifts weight arm 41 such that the resistance generated by device 10 will vary from the start of the motion to the end point.

FIGS. 1-9 illustrate lifting moment arm 30 and weighted moment arm 40 pivoting in opposing directions such that lifting wheel 34 will be more distal to weighted moment arm axle 42 at the start of the motion when weight arm 41 is in a lower and more horizontal position, and lifting wheel 34 will be more proximal to weighted moment arm axle 42 at the end point of the motion when weight arm 41 is in a higher more angular position. Therefore, FIGS. 1-9 illustrate embodiments wherein the resistance force generated by device 10 increases from the starting point to the end point of the motion.

FIGS. 10-13 illustrate lifting moment arm 30 and weighted moment arm 40 pivoting in the same direction such that lifting wheel 34 will be more proximal to weighted moment arm axle 42 at the start of the motion when weight arm 41 is in a lower and more horizontal position, and lifting wheel 34 will be more distal to weighted moment arm axle 42 at the end point of the motion when weight arm 41 is in a higher more angular position. Therefore, FIGS. 10-13 illustrate embodiments wherein the resistance force generated by device 10 decreases from the starting point to the end point of the motion.

In alternative embodiments not illustrated, lifting moment arm 30 and weighted moment arm 40 can be configured such that the resistance force generated by device 10 can increase or decrease from the start of the motion to the end point of the motion regardless of whether lifting moment arm 30 and weighted moment arm 40 pivot in opposite directions or the same direction as long as they each pivot on a separate axle in a separate location.

FIGS. 14-17 illustrate embodiments of the invention in which the lifting moment arm 30 and the weighted moment arm 40 pivot on a common axle 50. During operation of these embodiments, lifting wheel 34 will contact a point on the lower central point of weight arm 41 at the starting point of the motion and remain at or very proximal to that fixed point throughout the motion to the end point of the motion such that the lifting wheel 34 remains virtually the same distance from common axle 50 at all positions of weight arm 41 during the motion of device 10. Therefore, FIGS. 14-17 illustrate embodiments wherein the resistance force generated by device 10 remains virtually constant from the starting point when weight arm 41 is in a lower more horizontal position to the end point of the motion when weight arm 41 is in a higher more angular position.

In all preferred embodiments of the invention, the starting resistance of device 10 can be adjusted prior to the motion of device 10 by setting the location of lifting wheel carriage 33 and thus setting the location of lifting wheel 34, which will set the starting point contact location of lifting wheel 34 to weight arm 41. The function of lifting wheel carriage 33 is to support and move lifting wheel 34. Lifting wheel carriage 33 is comprised of lifting wheel carriage wheels 37 that support lifting wheel carriage 33 and move it along the lower section of lifting arm 31 when it is being repositioned on the lower section of lifting arm 31. The lifting wheel carriage 33 is guided by the lower portion of lifting wheel carriage guide 37 when lifting wheel carriage 33 is moved on lifting arm 31. The lifting wheel carriage 33 is secured in position by lifting wheel carriage latch 39 and lifting wheel carriage latch 39 latches to the upper portion of lifting wheel carriage guide 37. Lifting wheel carriage latch 39 is operatively connected to lifting wheel carriage adjustment handle 35 with lifting wheel carriage adjustment linkage 38. Lifting wheel carriage 33 can be supported and guided with various components such as linear bearings or bushings or other components that can move it along the lower section of lifting arm 31 and secure it to lifting arm 31.

In FIGS. 1-4, 6, 8, 10, and 13-15, lifting wheel carriage 33 is positioned more proximal (closer) to weighted moment arm axle 42 such that the resistance of the starting motion of device 10 is at a higher resistance setting. In FIGS. 5, 7, 11-12, and 16-17, lifting wheel carriage 33 is positioned more distal (farther) from weighted moment arm axle 42 such that the resistance of the starting motion of device 10 is at a lower resistance setting.

Prior to activation of device 10, in order to move and set the desired position of lifting wheel carriage 33 on lifting arm 31, the user of an exercise machine such as exercise machine 5 would grasp and move lifting wheel adjustment handle 35 so as to activate lifting wheel adjustment linkage 38 and unlatch lifting wheel carriage latch 39. While lifting wheel carriage latch 39 is in the unlatched position, the user would push or pull on lifting wheel adjustment handle 35 to move lifting wheel carriage 33 along lifting arm 31 to a desired position. The user then would active lifting wheel adjustment linkage 38 in the opposite direction by moving lifting wheel carriage adjustment handle 35 in the opposite direction so as to latch lifting wheel carriage latch 39 and secure lifting wheel carriage 33 in the desired position.

The motion of device 10 is generated by the activation and movement of an exercise machine such as exercise machine 5 that is operatively connected to device 10 as illustrated in FIGS. 1-4 and 9 as follows.

When a user exerts force upon the user engagement of exercise machine 5, exercise machine 5 and device 10 concurrently begin movement from the starting point position, causing transfer assembly 20 to activate such that drive axle 24 rotates, causing push rod connection tubes 21 to rotate upward, causing push rods 23 to move upward while pivoting on push rod pivots 22, thus causing lifting moment arm 30 to rotate upward on lifting moment arm axle 32 or common axle 50 such that lifting wheel 34 engages weight arm 41 and lifts weighted moment arm 40 as it rotates upward on weighted moment arm axle 42 or common axle 50 from a lower mostly horizontal starting point towards a higher more angular end point.

When a user reduces the exertion force on the user engagement of an exercise machines such as exercise machine 5, weighted moment arm 40 rotates downward on weighted moment arm axle 42 or common axle 50 from a higher more angular end point towards a lower more horizontal starting point wherein weight arm 41 is lowered by lifting wheel 34, lifting moment arm 30 rotates downward on lifting moment arm axle 32 or common axle 50, and push rods 23 move downward and pivot on push rod pivots 22, causing push rod connection tubes 21 to rotate downward and drive axle 24 to rotate in the opposite direction, causing exercise machine 5 and device 10 to move back towards the starting point position.

Exercise machine 5 and device 10 can be activated and moved to any position from the starting point position to the end point position, and exercise machine 5 and device 10 can be held at any location between the starting point position and the end point position.

FIGS. 1-4 and 9 illustrate the device 10 operatively connected to exercise machine 5 which as illustrated is a leg press machine. Device 10 can be operatively connected to various other exercise machines and operate as described herein, the leg press shown being only an exemplary exercise machine. One of ordinary skill in the art would be able to connect the device 10 to exercise machines 5 other than a leg press without undue experimentation.

Features and components of preferred embodiments of the present invention include at least one weighted moment arm, at least one lifting moment arm, and a force transfer assembly that are all operatively linked to form a direct drive resistance system. When operatively connected with an exercise machine, the direct drive resistance system provides a resistance to the exercise motion of the exercise machine that can be constant or variable.

While the invention has been described in connection with certain preferred embodiments, it is not intended to limit the spirit or scope of the invention to the particular forms set forth, but is intended to cover such alternatives, modifications, and equivalents as may be included within the true spirit and scope of the invention as defined by the appended claims.

What is claimed is:

1. A direct drive resistance system for exercise machines comprising:

a) a structural support frame;

b) a weighted moment arm pivotably connected to the support frame;

c) a lifting moment arm pivotably connected to the support frame;

d) a force transfer assembly pivotably connected to the support frame and operatively connected to the lifting moment arm;

e) an adjustable position lifting component movably mounted on the lifting moment arm; and f) a latching and unlatching mechanism for securing the adjustable position lifting component to a position on the lifting moment arm;

wherein the weighted moment arm, the lifting moment arm, the adjustable position lifting component, and the force transfer assembly are operatively engaged with each other such that the lifting moment arm and the adjustable position lifting component lifts and lowers the weighted moment arm during operation of the system.

2. The direct drive resistance system for exercise machines of claim 1, wherein the force transfer assembly is operatively connected to an exercise machine.

3. The direct drive resistance system for exercise machines of claim 2, wherein the force transfer assembly utilizes at least one push rod to transfer movement from the exercise machine to the lifting moment arm.

4. The direct drive resistance system for exercise machines of claim 3, wherein the resistance created by the motion of the system increases as the weighted moment arm is lifting, decreases as the weighted moment arm is lowering, and remains constant when the weighted moment arm is activated and held in a stationary position.

5. The direct drive resistance system for exercise machines of claim 4, wherein the adjustable position lifting component is adjustable and latchable into a position on the lifting moment arm prior to activation of the system so as to set the resistance of the system at the starting position.

6. The direct drive resistance system for exercise machines of claim 1, wherein the weighted moment arm, the lifting moment arm, and the force transfer assembly all rotate less than 180 degrees during operation of the system.

* * * * *